United States Patent [19]

Barry et al.

[11] 4,451,814

[45] May 29, 1984

[54] NON-RESETTABLE THERMAL FUSE

[75] Inventors: Leon G. Barry; Willis E. Rieman, both of Shelby, N.C.

[73] Assignee: Fasco Controls Corporation, Shelby, N.C.

[21] Appl. No.: 387,968

[22] Filed: Jun. 14, 1982

[51] Int. Cl.[3] ..... H01H 37/76

[52] U.S. Cl. ..... 337/407; 337/403

[58] Field of Search ..... 337/407, 408, 409, 403, 337/405

[56] References Cited

U.S. PATENT DOCUMENTS

| | | | |
|---|---|---|---|
| 530,430 | 12/1894 | Klein | 337/403 |
| 1,932,783 | 10/1933 | Howard | 337/407 |
| 3,043,937 | 7/1962 | Milton . | |
| 3,198,914 | 8/1965 | Baran | 337/405 |
| 3,436,712 | 4/1969 | Heaney | 337/405 |
| 3,602,864 | 8/1971 | Burney | 337/407 |
| 3,629,766 | 12/1971 | Gould | 337/407 |
| 3,652,195 | 3/1972 | McIntosh et al. | 337/407 |
| 3,806,680 | 4/1974 | Link | 337/405 |
| 3,952,274 | 4/1976 | Plasko | 337/408 |
| 3,956,725 | 5/1976 | Merrill | 337/407 |
| 4,080,586 | 3/1978 | Hay | 337/409 |
| 4,135,177 | 1/1979 | Kelley | 337/408 |
| 4,179,679 | 12/1979 | Houghland | 337/408 |
| 4,383,236 | 5/1983 | Urani et al. | 337/403 |

*Primary Examiner*—Harold Broome

*Attorney, Agent, or Firm*—Shlesinger, Fitzsimmons & Shlesinger

[57] ABSTRACT

Two wire leads project from opposite ends of a dielectric housing having a sealed chamber containing a fusible metal alloy link, which operatively connects the wire leads electrically to one another. A flexible, preloaded, dielectric spring element in the chamber engages and exerts upon the link a predetermined stress, which is operative to cause the link suddenly to fail and interrupt the connection between the leads, when the ambient temperature of the link exceeds a predetermined temperature range. In one embodiment the two wire leads project into the chamber and have spaced, confronting ends interconnected by the link, one side of which is held under compressive stress by the spring element. In a second embodiment a sinuous spring element is formed on one end of one lead, and extends into the chamber where its free end is soldered under tension to one wall of the chamber in electrical contact with the second lead wire, so that when the link melts the tensioned spring element is disconnected from the second lead wire.

9 Claims, 7 Drawing Figures

NON-RESETTABLE THERMAL FUSE

BACKGROUND OF THE INVENTION

This invention relates to thermal fuses, and more particularly to fuses of the non-resettable variety. Even more particularly, this invention relates to a thermal fuse of the type in which a preloaded spring element interrupts current flow in a wire lead, when a fusible alloy section of the lead melts.

There are many conventional thermal fuses which utilize fusible pellets for retaining the electrical contacts of a fuse in their engaged or circuit-completing positions until such time as the ambient temperature of the fuse exceeds a predetermined value. When the last-named temperature is reached the fusible pellet melts suddenly, and one spring-loaded contact is disengaged from the other, thereby interrupting current flow through the fuse. Certain such fuses are capable of being reset or reused after the circuit that has been interrupted; and other such fuses are destroyed, or are incapable of being reset after the fusible material has been melted. This invention relates to the non-resettable type fuse.

Among the non-resettable fuses, which utilize fusible pellets or the like for retaining a spring-loaded circuit interrupter in an inoperative position, are the devices disclosed in U.S. Pat. Nos. 3,155,800 and 4,030,061. In the case of the former patent, a spring-loaded plunger is retained by a fusible pellet in a retracted position; and when the ambient temperature of the fuse exceeds a predetermined value the plunger is released and severs a small wire jumper, which normally interconnects the adjacent ends of two separate sections of a wire conductor. The device shown in U.S. Pat. No. 4,030,061 also utilizes a spring-loaded plunger which is normally held by a fusible pellet in its retracted position. When the pellet melts a plunger severs directly through a wire lead, thus interrupting the current flow in the lead.

One of the disadvantages of prior such fuses is that a rather complicated spring-loading mechanism must be employed to preload a plunger, which is ultimately used to interrupt current flow in the fuse. Also in such prior art devices the fusible pellet is independent of the current carrying conductor, and is not designed to carry current.

It is an object of this invention, therefore, to provide an improved, non-resettable thermal fuse, which is substantially less complicated and simpler to manufacture than prior such fuses.

Another object of this invention is to provide an improved thermal fuse of the type described which combines a preloaded spring element and a fusible alloy link to produce a relatively simple fuse which is designed positively to interrupt current flow when the ambient temperature of the fuse exceeds predetermined value.

Still another object of this invention is to provide an improved thermal fuse of the type described which is particularly suited for inexpensive, mass production.

SUMMARY OF THE INVENTION

In one embodiment this fuse comprises a conductive wire lead a portion of which is molded into a high temperature plastic case. The case has therethrough a window which exposes a portion of the wire lead intermediate its ends. A narrow gap or space is blanked into the exposed section of the wire; and the gap is in turn filled with a metal alloy link or plug having a narrow, controlled melting point. A plastic cover member, which is secured in and closes one side of the window opening, has thereon an integral, resilient barrier section one edge of which is urged resiliently against the metal alloy link when the latter is at room temperature. The case is enclosed in a transparent sleeve, so that the metal alloy section of the fuse is visible through one side of the window. When the ambient temperature of the fuse exceeds a predetermined value the metal alloy melts suddenly, and the spring-loaded barrier section passes through the gap between the adjacent ends of the wire lead to interrupt current flow therethrough.

In a second embodiment one lead wire projects into a chamber in an insulator, and has on its inner end a sinous, resilient spring section (e.g. brass) the free end of which is soldered by a fusible metal alloy to a metal cover which is secured over an opening in the opposite end of the chamber, and which in turn is secured to a second lead wire. The spring section of the first lead is held under tension by the fusible alloy until the latter melts, at which point the tensioned section pulls away from the metal cover to interrupt the connection between the leads.

THE DRAWINGS

DETAILED DESCRIPTION OF THE PREFERRED EMBODIMENTS

Figure 1:
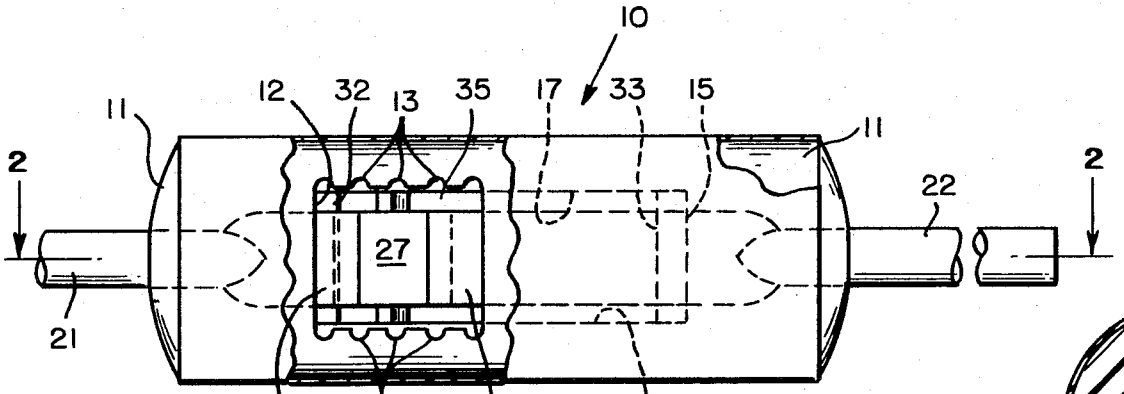
FIG. 1 is a fragmentary side elevational view of a thermal fuse made according to one embodiment of this invention, portions of the casing wrap being cut away for purposes of illustration.
Figure 3:
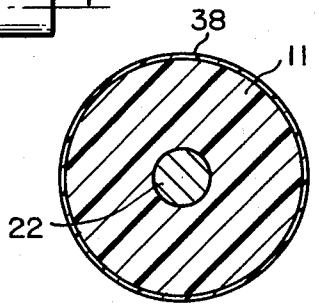
FIG. 3 is a sectional view taken along the line 3—3 in FIG. 2 looking in the direction of the arrows.

Referring now to the drawings by numerals of reference, and first FIGS. 1 to 4, 10 denotes generally a cylindrically shaped, dielectric casing or housing having therethrough a diametral window or opening 12, which is generally rectangular in cross section. Each of the opposed, parallel sidewalls of opening 12 has therein a plurality of spaced, parallel grooves 13, which extend parallel to the axis of the opening, and opposite ends of which open on the circumferential surface of the casing. Adjacent one end (the upper end in FIG. 2) window 12 communicates with a large, rectangular recess 15, which extends part way inwardly from the outer peripheral surface of casing 11, and which has opposed, parallel sidewalls 16 and 17 that register with the grooved sidewalls of opening 12.

Secured intermediate their ends in opposite ends of the casing 11 are two, spaced wire leads 21 and 22, which have cylindrically shaped outer ends that extend exteriorly of casing 11, and blanked or flattened inner ends 23 and 24, respectively, which project into the window 12 between its grooved sidewalls, and in spaced confronting relation to each other. The inner ends 23 and 24 of the leads are rectangular in cross section, and have thereon spaced, parallel, confronting edges 25 and 26, respectively, which are operatively connected to each other by a fusible metal alloy link 27, which can be made, for example, for an indium alloy or the like. The link 27 is also rectangular in cross section, and is coplaner with the flat inner ends 23 and 24 of the leads. Moreover, to secure the link 27 against accidental dislocation from between the confronting edges 25 and 26 of the leads, the link has formed along opposite side edges thereof integral flange sections 28 and 29, which seat in registering recesses formed in the upper surfaces (FIG. 2) of the flattened ends 23 and 24 of the leads.

Figure 2:
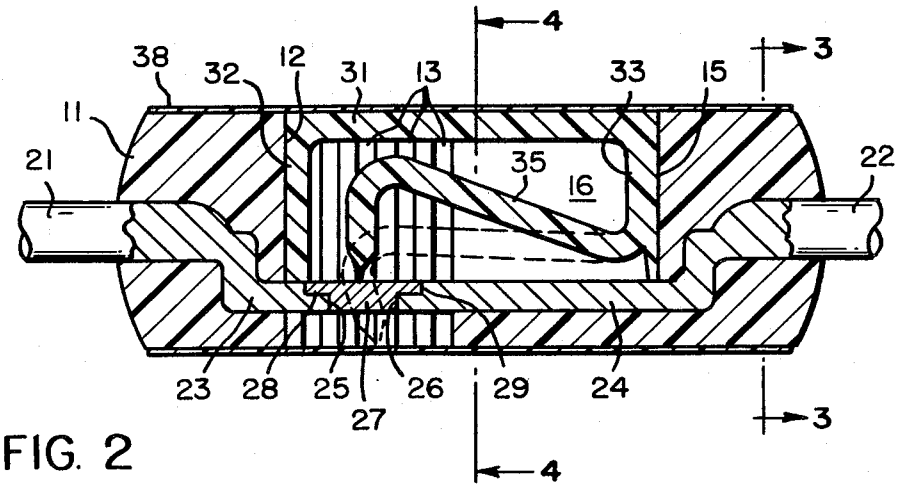
FIG. 2 is a fragmentary sectional view taken generally along the line 2—2 in FIG. 1 looking in the direction of the arrows, but with the lead wire sections being shown in full.
Figure 4:
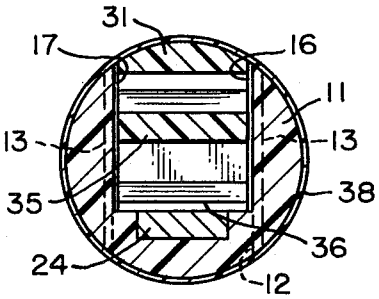
FIG. 4 is a sectional view taken along the line 4—4 in FIG. 2 looking in the direction of the arrows.

Mounted in the upper end of the opening 12, as shown for example in FIG. 2, and extending snugly into the registering recess 15 in casing 11, in an inverted, generally U-shaped, dielectric cover 31, which has at opposite ends thereof a pair of spaced, parallel, downwardly extending legs or endwalls 32 and 33, which overlie the inner ends 23 and 24 of the wire leads adjacent opposite sides of link 27. The endwall 33, which is furthest from the link 27, has projecting from its lower edge an integral, flexible, pivotal spring element 35, which as shown in FIG. 2 extends upwardly and rearwardly beneath the cover 31 toward its other endwall 32, and over the link 27. Adjacent the endwall 32 the pivotal spring element 35 has a generally hook-shaped end which curves downwardly and has formed thereon a tapered or knife-shaped edge 36, which engages the upper surface of the link 27 along a line positioned approximately midway between, and parallel to, the confronting edges 25 and 26 of the lead wires 21 and 22.

Preferably the cover 31 and its flexible spring element 35 are made from a polysulfone material, which has a high tensile strength, and a high flexural modulus of elasticity. Moreover, the cover 31 is made so that its spring element 35 normally tends to assume its untensioned or unflexed position as shown by broken lines in FIG. 2. However, when the cover 31 is initially assembled into the casing 11, the lower edge 36 of its spring element 35 is urged into engagement with the link 27 with sufficient force to cause the element 35 to be pivoted upwardly from its broken line to its solid line position in FIG. 2. In this position the cover is secured in place in casing 11 by a layer 38 of transparent tape, which is wrapped around the outer, circumferential surface of casing 11, thereby operatively to secure the cover 31 sealingly in the casing, and to maintain its spring element 35 in a stressed condition.

In use, and assuming that the leads 21 and 22 are used to connect the fuse 10 in an electric circuit, when the ambient temperature of the fuse rises to a point where it exceeds a predetermined operating range, the fusible link 27 begins to soften or melt and the preloaded or flexed spring element 35 urges its tapered edge 36 suddenly downwardly through the link 27, and into its broken line position as shown in FIG. 2. This interrupts the mechanical and electrical connection between the wire leads 21 and 22, and thus interrupts current flow in the associated circuit. The downwardly projecting end of the spring element 35 thus acts as a barrier producing both a mechanical and a electrical separation of the confronting lead wire ends 23 and 24. Normally when the fuse fails the link 27 will melt, and the grooves 13 in the opposed sidewalls of the window 12 are provided to assure ample space for accommodating the melted allow metal, and to provide a discontinuity which prevents accidental reactivation of the fuse as might occur if the melted alloy material were to flow back into bridging engagement with the ends 23 and 24 of the leads.

As shown in FIG. 1, the spring element 35 on cover 31 is wider than each of the flattened sections 23 and 24 of the wire leads, and is only slightly narrower than the width of window 12 and its associated recess 15. This permits freedom of the spring element 35 to pivot within the window area 12 and recess 15, but also assures that the hooked or barrier end of the spring element will extend beyond opposite ends of the gap or space between the confronting edges 25 and 26 of the wire leads, so that no bridging alloy material will be left between these confronting ends when the fuse interrupts the circuits—i.e., when the spring element 35 moves from its solid to its broken line position as shown in FIG. 2.

From the foregoing it will be apparent that the above-described fuse provides a relatively simple and inexpensive means for interrupting circuit operations when the ambient temperature of the fuse exceeds a predetermined value. By selecting the proper metal alloy for the link 27, it is possible to calibrate the fuse to effect circuit interruption at a predetermined ambient temperature of the fuse. The cover 31 and its associated spring element 35 are made from a plastic, electrically non-conductive material, so that the only current-carrying elements of the fuse consist of the two wire lead sections 21, 22 and the fusible metal alloy link or plug 27. This not only reduces the overall cost of the fuse, but also simplifies its assembly. Moreover, by using the transparent tape 38, the disposition of the fuse can be determined simply by viewing the bottom of the link 27 through the lower end of the opening or window 12, as shown in FIG. 2. It is therefore possible to make a visual determination as to whether or not the fuse has failed.

Still another advantage of this fuse is that it is particularly suited for automated assembly. For example, lead wire from a coil thereof can be stamped or flattened at spaced points along its length, after which a windowed case 11 can be molded over each flat section of the wire. Thereafter each flat section of wire can be blanked through the window in the casing to form the gap or space between the confronting edges 25 and 26 of the flattened wire sections. The fuse links or metal plugs 27 are then die cast or molded to bridge the gap or space between the confronting lead wire ends 25 and 26 in each casing 11. Thereafter the cover member 31 is inserted in each casing, at which time the assembly can be tested for continuity, if desired. If satisfactory, the layer 38 of transparent tape can then be wrapped around the outside of each casing to seal within its opening 12 the cover member 31 and the link 27. Since the casings 11 are molded around the flattened sections of the wire lead material, before the gaps are blanked between each pair of wire leads, the assembled fuses can be cut from the wire supply before being packaged, or alternatively, the assembled fuses can remain in a continuous chain and may be shipped in reels for automatic assembly by a customer.

Referring now to FIGS. 5 to 7, 40 denotes generally a modified fuse comprising a metal can 41, which has one end of a wire lead 42 secured to and projecting from the closed end of the can 41 externally thereof. Secured in the can 41 coaxially thereof is a generally cup-shaped insulator 43, the open end of which is positioned in spaced, confronting relation to the closed end of can 41. Secured intermediate its ends in an axial bore in the closed end of the insulator 43 is a spring wire lead 44, which can be made, for example, from brass or the like. Lead 44 has formed on its inner end a sinuous spring section 45, which extends generally coaxially into a cylindrical chamber 46, which is formed in the open end of insulator 43. The end of the spring element 45 remote from lead 44 is secured in chamber 46 against the closed end of can 41 by a fusible metal alloy link 47, which operatively connects lead 44 electrically with lead 42.

Figure 6:
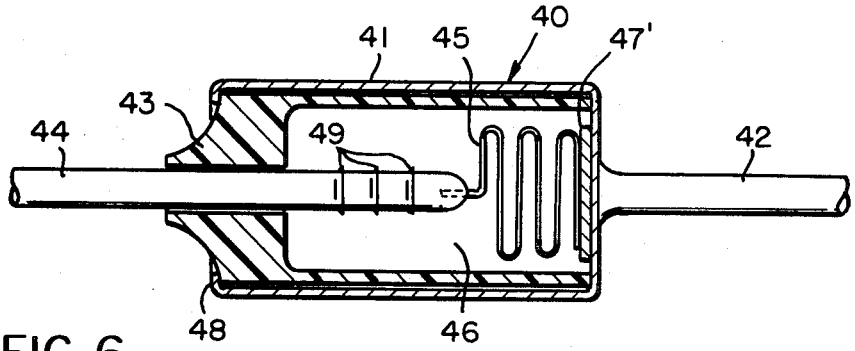
FIG. 6 is a view similar to FIG. 5, but showing this second embodiment of the fuse as it appears during assembly thereof, and prior to the time the fuse elements are placed in the positions as shown in FIG. 5.

The fuse 40 can be produced, for example, first by inserting the wire lead 44 part way into the axial bore in the insulator 43 until lead 44 assumes, relative to the insulator 43, the position shown in FIG. 6. Thereafter a fusible metal alloy chip 47′ (FIG. 6) is placed in the bottom of the can 41, after which insulator 43, with the wire lead 44 therein, is inserted into can 41 to the position shown in FIG. 6. The open end of the can 41 is then crimped over the left end of the insulator 43, as shown at 48, thereby to secure the insulator in can 41 in the position shown generally in FIG. 6. At this stage the right or terminal end of the spring section 45 of lead 44 is seated against the chip 47′ resiliently to hold the latter against the closed end of can 41.

Figure 5:
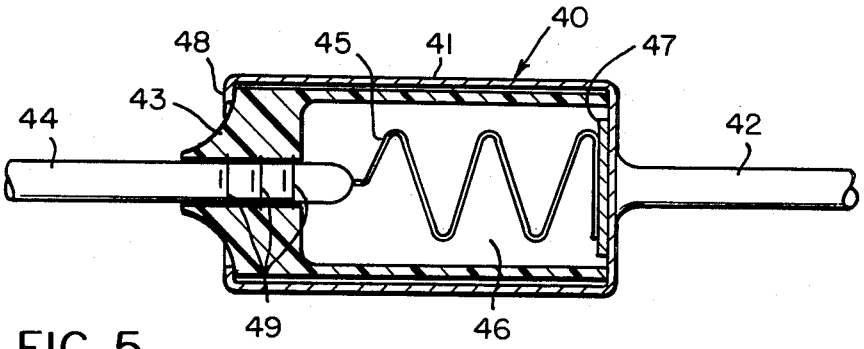
FIG. 5 is a fragmentary, axial section view taken through the center of a thermal fuse made according to the second embodiment of this invention.
Figure 7:
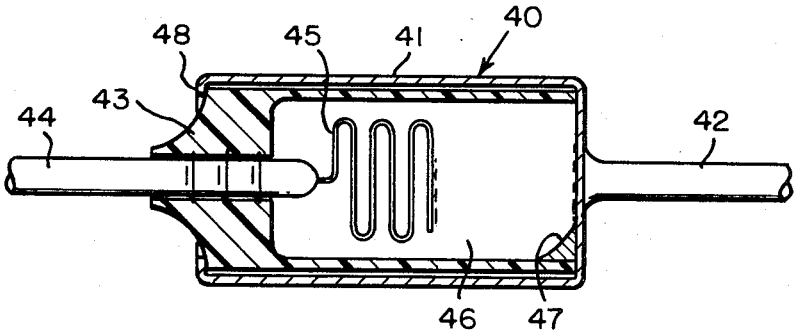
FIG. 7 is a view similar to FIG. 5, but showing this modified fuse as it appears after failure.

The ambient temperature of the assembly is then elevated sufficiently to cause the alloy chip 47′ momentarily to melt, thus operatively "soldering" the free end of the spring section 45 to the closed section of can 41. Thereafter lead 44 is withdrawn toward the left (FIG. 6) relative to the insulator 43 untii a plurality of burrs 49 on the outer periphery of lead 44 fixedly engage the bore wall in insulator 43 as shown in FIG. 5, at which time the spring section 45 of the lead will have been placed under tension. The degree of tension in spring 45 is calibrated so that, when the ambient temperature of fuse 41 once again is elevated to a point at which the link 47 melts, the tensioned section 45 will cause its free end to be drawn suddenly away from the closed end of the can 41, and into an inoperative or circuit interrupting position as shown in FIG. 7. The advantage of this construction is that it employs only four different parts for manufacturing the fuse, and is therefore easier to assemble and more inexpensive to manufacture than prior thermal fuses.

In view of the foregoing, it will be apparent that the present invention provides a relatively simple, inexpensive, nonresettable thermal fuse, which requires only four or five different parts in order to manufacture each fuse. Moreover it is possible to utilize the fusible alloy directly in the current carrying circuit so that the need for additional metal contacts is eliminated. By employing a spring-loaded or flexed element for triggering the fuse failure when a predetermined elevated temperature is reached, it is possible to provide a more reliable circuit interruption at a minimum cost. Furthermore, by using a dielectric barrier element 35 in the gap between the confronting ends of a blown fuse, the melted fuse material is prevented from accidentally flowing back into bridging relation with the fuse leads. Also, applicants' invention greatly simplifies the automated assembly of fuses made in accordance with this invention.

While it has been suggested that the fusible metal employed in this invention be an idium alloy, it will be apparent that various other types of alloys can be used to perform the same function, such as for example alloys of bismuth, lead, tin and mixtures thereof. Typically such alloys can be utilized to produce fuses having temperature ratings in the range of from 136° F. to 465° F. Likewise, although only polysulfone has been mentioned as a specific ingredient for manufacturing the cover 31, it will be apparent that other non-conductive materials can be employed provided they are capable of forming a flexible barrier element which functions in a manner similar to element 35. Also, rather than being flat, the link 27 could be a round, wire-type fusible alloy, which could be attached to the inner confronting ends of the leads (which in such case might also be round) as by soldering (e.g. by laser), or even crimped to the leads.

Having thus described our invention, what we claim is:

1. A thermal fuse, comprising a dielectric housing having therein a sealed chamber, a pair of spaced wire leads projecting from opposite ends, respectively, of said housing, a fusible metal alloy link positioned in said chamber and operative normally to form at least part of an electrical connection between said pair of leads, a flexible, preloaded spring element engaged with said link normally to exert a predetermined stress thereon, and operative, when the ambient temperature of said link exceeds a predetermined temperature range, suddenly to interrupt said electrical connection between said leads, said spring element being a sinuous metal wire fixed at one end to one of said leads, and releasably secured under tension at its opposite end to a stationary surface in said chamber by said link, and in electrical connection with the other of said leads, a metal cover secured over an opening in one end of said chamber, said alloy link being secured to the inside of said cover to face said chamber and said other lead is secured to the outside of said cover, and said sinuous metal wire being integral at said one end thereof with said one lead, and having said opposite end thereof embedded in said alloy link to be held in tension thereby until the ambient temperature of said link exceeds said predetermined temperature range.

2. A thermal fuse comprising a dielectric housing having therein a sealed chamber, a pair of spaced wire leads projecting from opposite ends, respectively, of said housing, a fusible metal alloy link positioned in said chamber and operative normally to form at least part of an electrical connection between said pair of leads, a flexible, preloaded spring element engaged with said link normally to exert a predetermined stress thereon, and operative, when the ambient temperature of said link exceeds a predetermined temperature range, suddenly to interrupt said electrical connection between said leads, said housing having therethrough a central opening forming at least part of said chamber, and opposite ends of said opening being sealed by a layer of insulating material which is secured to the outside of said housing said leads projecting into said central opening and having a space between the confronting ends thereof filled by said metal alloy link, whereby said leads normally are electrically connected to each other, and said spring element comprising a dielectric member secured in said central opening beneath said layer of insulating material, and having thereon a flexible projection which is pivotal between a first position in which it exerts compressive stress on one side of said metal alloy link, and a second position in which it extends transversely into said space between said confronting ends of said leads to interrupt the electrical connection therebetween, when said metal alloy link is heated above said predetermined temperature range.

3. A thermal fuse as defined in claim 2, wherein at least the portion of insulating material which covers one end of said central opening is transparent.

4. A thermal fuse, comprising a dielectric insulator having therein a sealed chamber, a pair of spaced wire leads secured intermediate their ends in said insulator, and having a pair of outer ends extending exteriorly of the insulator, and a pair of inner ends extending into said chamber in spaced, confronting relation to each other, a fusible metal alloy link secured to and extending between said confronting inner ends of said leads normally to provide an electrical connection between said leads, and a dielectric member mounted in said chamber at one side of said link and having integral therewith a pivotal arm which projects into a recess in said member, and which has a free end disposed to register with the space between said inner ends of the leads, and normally to be pivoted resiliently against said one side of said link, said free end of said arm being operative to displace said link and to pass into the space between said confronting ends of said leads to interrupt the electrical connection therebetween, when the ambient temperature of said link exceeds a predetermined temperature range.

5. A thermal fuse, comprising a dielectric insulator having therein a sealed chamber, a pair of spaced wire leads secured intermediate their ends in said insulator, and having a pair of outer ends extending exteriorly of the insulator, and a pair of inner ends extending into said chamber in spaced, confronting relation to each other, a fusible metal alloy link secured to and extending between said confronting inner ends of said leads normally to provide an electrical connection between said leads, a dielectric barrier member mounted in said chamber at one side of said link to register with the space between said inner ends of the leads, and normally to be urged resiliently against said one side of said link, said barrier member being operative to displace said link and to pass into the space between said confronting ends of said leads to interrupt the electrical connection therebetween, when the ambient temperature of said link exceeds a predetermined temperature range, said insulator being generally cylindrical in configuration and having therethrough a diametral opening opposite ends of which are sealed closed by a layer of insulation that is secured to the outside of said insulator, whereby said opening in said insulator defines at least part of said sealed chamber, said inner ends of said leads projecting into said opening from opposite sides thereof, and supporting said link in a plane extending transversely of said opening, and at least the portion of said layer of insulation covering one end of said diametral opening in the insulator being transparent so that said link is visible from the exterior of said insulator.

6. A thermal fuse comprising a dielectric insulator having therein a sealed chamber, a pair of spaced wire leads secured intermediate their ends in said insulator, and having a pair of outer ends extending exteriorly of the insulator, and a pair of inner ends extending into said chamber in spaced, confronting relation to each other, a fusible metal alloy link secured to and extending between said confronting inner ends of said leads normally to provide an electrical connection between said leads, a dielectric barrier member mounted in said chamber at one side of said link to register with the space between said inner ends of the leads, and normally to be urged resiliently against said one side of said link, said barrier member being operative to displace said link and to pass into the space between said confronting ends of said leads to interrupt the electrical connection therebetween, when the ambient temperature of said link exceeds a predetermined temperature range, said barrier member comprising a hook-shaped projection formed on a dielectric cover member that is secured in said chamber at said one side of said alloy link, said projection being integral at one end with said cover member and having its opposite, hook-shaped end mounted to pivot between an operative position in which it engages said one side of said alloy link and an inoperative, circuit-interrupting position in which it extends into the space between the inner ends of said leads.

7. A thermal fuse as defined in claim 6, wherein said cover member is made from a polysulfone material.

8. A thermal fuse as defined in claim 7, wherein said fusible metal alloy is selected from the group consisting of alloys of bismuth, lead, tin and indium.

9. A thermal fuse as defined in claim 5, wherein opposed side walls of said diametral opening through said insulator have therein a plurality of spaced, parallel grooves that extend axially of said opening.

* * * * *